US006327982B1

(12) United States Patent
Jackson

(10) Patent No.: US 6,327,982 B1
(45) Date of Patent: Dec. 11, 2001

(54) ADJUSTABLE COMPUTER STAND

(76) Inventor: Stephen Jackson, 5400 Carillon Point, Kirkland, WA (US) 98033

( * ) Notice: Subject to any disclaimer, the term of this patent is extended or adjusted under 35 U.S.C. 154(b) by 0 days.

(21) Appl. No.: 09/619,005

(22) Filed: Jul. 19, 2000

Related U.S. Application Data

(60) Provisional application No. 60/161,887, filed on Oct. 27, 1999, now abandoned.

(51) Int. Cl.[7] ..... A47F 5/12

(52) U.S. Cl. ..... 108/5; 248/418; 248/457; 108/142; 108/147.2

(58) Field of Search ..... 108/1, 4, 5, 10, 108/141, 147.2, 142; 248/447, 454, 457, 458, 521, 516, 413, 415, 416, 418, 157, 419

(56) References Cited

U.S. PATENT DOCUMENTS

| | | | | |
|---|---|---|---|---|
| 161,026 | * | 3/1875 | Grummon | 108/4 |
| 1,653,657 | * | 12/1927 | Pretsch | 108/141 |
| 3,230,908 | * | 1/1966 | Grant | 108/142 |
| 4,077,333 | | 3/1978 | Ballas . | |
| 4,401,036 | | 8/1983 | Russo et al. . | |
| 4,687,167 | | 8/1987 | Skalka et al. . | |
| 4,779,540 | | 10/1988 | Dion et al. . | |
| 5,143,341 | | 9/1992 | Juster . | |
| 5,732,910 | | 3/1998 | Martin . | |

FOREIGN PATENT DOCUMENTS

| | | | | |
|---|---|---|---|---|
| 1372652-A | * | 4/1964 | (FR) | 108/10 |

* cited by examiner

*Primary Examiner*—Peter M. Cuomo
*Assistant Examiner*—Jerry A. Anderson
(74) *Attorney, Agent, or Firm*—Dean A. Craine

(57) ABSTRACT

This invention is an adaptable computer stand designed to support a laptop computer or keyboard over a user's lap while sitting in a chair or bed. The stand includes a wide, low profile base designed to fit under a living room chair commonly found in a home. Attached perpendicularly to the base is a vertically aligned, fixed pole. Attached to the upper end of the fixed pole is an adjustable, L-shaped extension pole designed to be selectively raised or lowered on the fixed pole, rotate, and then lock in a desired position. Attached to the upper end of the extension pole is a length-adjustable, rotating extension arm. The stand also includes a planar support member used to support a keyboard or laptop computer. Attached to the bottom surface of the support member is a locking universal joint, which, during assembly, is connected to the distal end of the extension arm. The universal joint enables the support member to tilt and rotate as desired.

8 Claims, 4 Drawing Sheets

ADJUSTABLE COMPUTER STAND

This is a utility patent application based on a provisional patent application (Ser. No. 60/161,887) filed on Oct. 27, 1999 now abandoned.

BACKGROUND OF THE INVENTION

1. Field of the Invention

This invention pertains to stands or supports used to hold a laptop computer or keyboard.

2. Description of the Related Art

Today, laptop computers are commonly used in homes and motel rooms without a desk or table. When used while sitting in a chair or bed, the laptop computer must be supported on the user's lap. Unfortunately, in a short time the bottom of the laptop computer becomes hot and begins to bum the user's legs. Without a mouse support surface, the user is also forced to use the touch pad or point stick provided with the laptop computer. Also, the position of the keyboard is unsuitable for proficient typing.

Portable food stands are widely used in hospitals to support a tray of food for a patient lying in a bed. Because hospital beds have tall open areas under the bed frame, the legs on the stands are able to freely extend under the bed to position the food tray over the patient.

The height and design of chairs and beds at home varies greatly and do not have tall open areas under them to accommodate the legs used on portable hospital food stands. What is needed is an adaptable computer stand that can be used with a wide variety of different chairs and beds.

SUMMARY OF THE INVENTION

It is an object of the present invention to provide a portable stand capable of being used to support a laptop computer or keyboard over a user's lap while sitting.

It is an object of the present invention to provide such a stand designed for use with chairs, couches, or beds, commonly used in homes, that have short open areas under them.

It is another object of the present invention to provide such a stand adaptable to different types of chairs, couches, and beds, different sized individuals, and different sitting and reclining positions, as well as standing up.

These and other objects of the invention, which will become apparent, are met by the computer stand disclosed herein. The computer stand is used to support a laptop computer or keyboard over a user's lap while sitting in a chair or bed. The stand includes a wide, low profile base designed to extend into the short open area located under a chair or bed commonly found in a home. Attached perpendicularly to the base is a vertically aligned fixed pole. The fixed pole is attached to the rear member on the base so that the side members on the base may be placed under the chair and the fixed pole may be placed immediately adjacent to the side of the chair. By placing the base under the chair, the stand is able to remain upright during use.

Attached to the upper end of the fixed pole is an adjustable extension pole designed to be selectively raised or lowered on the fixed pole. During use, the extension pole slides longitudinally inside the fixed pole to a desired elevation and is then locked in position with a locking mechanism disposed between the upper end of the fixed pole and the lower section of the extension pole. In one embodiment, the extension pole is designed to rotate 360 degrees around the longitudinal axis of the fixed pole.

Attached to the distal end of the extension pole is an adjustable extension arm that holds the support surface horizontally over the edge or seat of the chair or bed. In the preferred embodiment, the fixed extension pole and extension arm are both circular in cross section. During use, the extension arm is able to rotate and slide longitudinally inside the upper section of the extension pole, thereby enabling the relative position of the support member to the fixed pole to be selectively adjusted by the user. A locking means is disposed between the distal end of the extension pole and the proximal end of the extension arm thereby enabling the extension arm to be locked in a desired position on the extension pole. In a second embodiment, a pivoting means is provided between the extension pole and extension arm that enables the proximal end of the extension arm to pivot 360 degrees around a vertical axis. In a third embodiment, the base is Y-shaped with two extending legs aligned longitudinally at least 90 degrees apart, so that the base can be positioned around a corner leg on the chair. Limiting means are disposed between the fixed pole and extension pole that limit the arc of rotation of the extension pole over the fixed pole to the two leg members on the base so that the stand does not tip over during use.

As mentioned above, attached to the distal end of the extension arm is a planar support member used to support a keyboard or laptop computer. A universal joint is disposed between the distal end of the extension arm and the bottom surface of the support member. During use, the user is able to selectively rotate and tilt the support member relative to the extension arm at any desired position for comfort and stability. An optional lip may be attached or formed on the front edge of the support member to prevent the keyboard or laptop computer from sliding off the support member during use.

DESCRIPTION OF THE PREFERRED EMBODIMENT(S)

Figure 1:
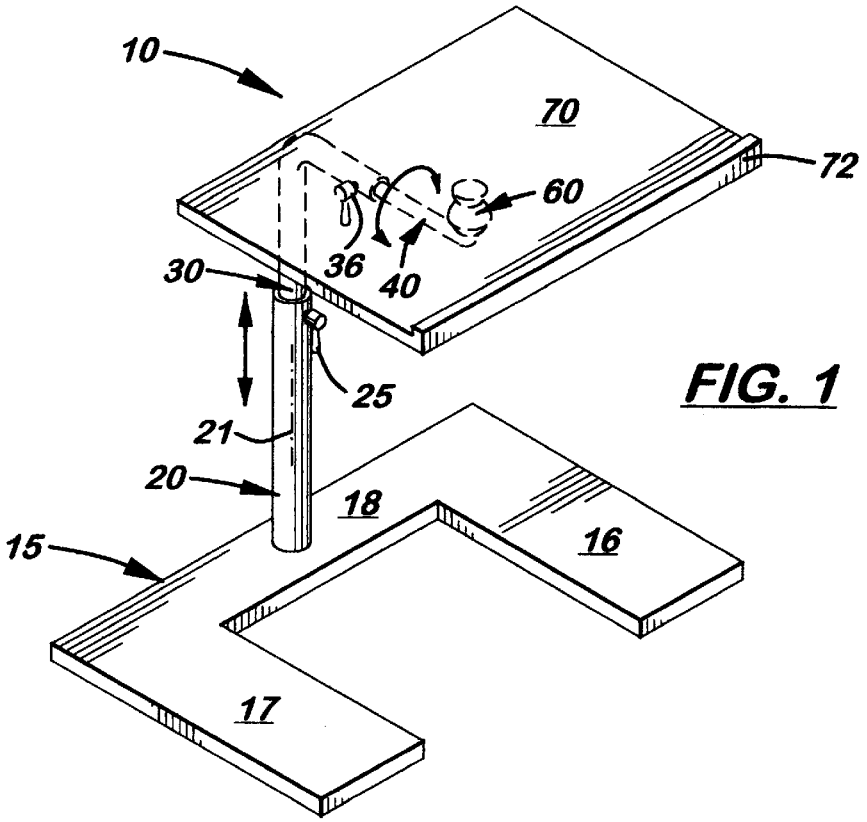
FIG. 1 is a perspective view of the adaptable computer stand disclosed herein.

Referring to the accompanying FIGS. 1–10, there is shown and described a computer stand generally referenced as 10 used to support a laptop computer or keyboard over a user's lap while sitting in chair 92 or bed. The stand 10 includes a wide, low profile base 15 designed to extend into the narrow space 93 created under a chair 92 (see FIG. 2) or bed. In the first embodiment, the base 15 is U-shaped with two parallel side members 16, 17, and one perpendicularly aligned rear member 18. The base 15 includes four short feet 19, measuring approximately ½ inch in height, attached to the bottom surface to reduce friction and prevent scratching of the floor during use. The overall dimensions of the base 15 are 20 inches by 13 inches (L×W) and ¾ inch in thickness. It is made of heavy material such as polished or painted steel, to act as a counter weight to support light pressure exerted by the laptop computer or the user's hands and arms.

Figure 2:
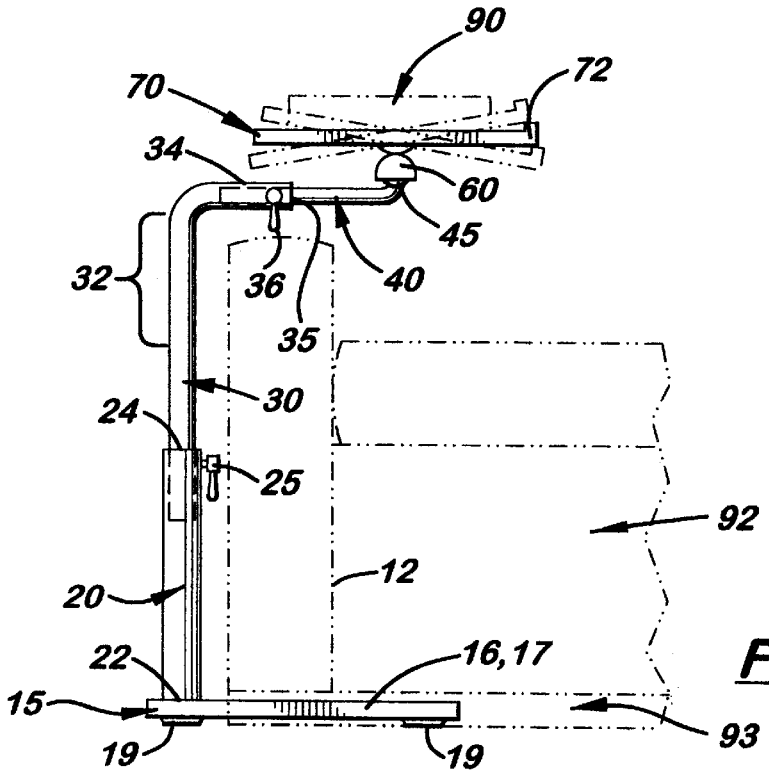
FIG. 2 is a side elevational view of the computer stand showing the forward and backward tilting movement of support member.

Attached perpendicularly to the base 15 is a vertically aligned fixed pole 20. The fixed pole 20 is attached at its lower end 22 to the center axis of the rear member 18. The lower end 22 of the fixed pole 20 is securely attached to the base 15 by any suitable connector or adhesive. In the preferred embodiment, the fixed pole 20 is a hollow tube made of steel or aluminum approximately 1¼ inches in diameter and approximately fourteen (14) inches in length. During use, the side members 16, 17 are extended approximately twelve (12) inches under the chair 92 so that the fixed pole 20 may be placed adjacent to the side of the chair 92 as shown in FIG. 2.

Attached to the upper end 24 of the fixed pole 20 is an adjustable, L-shaped extension pole 30. During use, the extension pole 30 slides longitudinally inside the fixed pole 20 to a desired elevation. In the preferred embodiment, the extension pole 30 is also a hollow tube made of steel or aluminum approximately one (1) inch in diameter. The lower section 32 of the extension pole 30 measures approximately fifteen (15) inches in length while the upper section 34 of the extension pole measures approximately seven (7) inches in length. During assembly, the lower section 32 of the extension pole 30 is extended into the fixed pole 20. During use, the extension pole 30 is able to rotated 360 degrees around the longitudinal axis 21 of the fixed pole 20 so that the upper section 34 extends transversely over the base 15 near the center axis 12. A locking nut 25 is provided between the upper end 24 of the fixed pole 20 and the lower section 32 of the extension pole 30 to lock the extension pole 30 in position.

Figure 4:
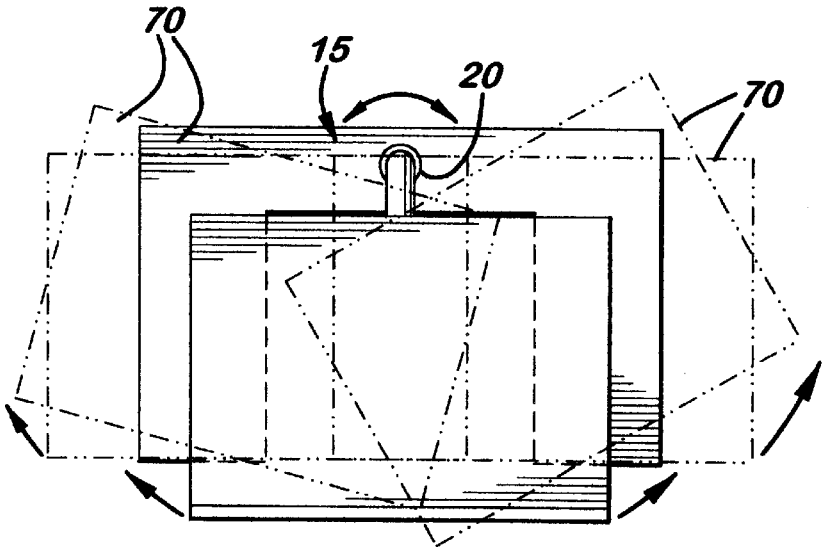
FIG. 4 is a top plan view of the computer stand showing the rotational movement of the extension arm and the support member.

Attached to the upper distal end 35 of the extension pole 30 is an extension arm 40. In the first embodiment, the extension arm 40 is a hollow tube approximately ⅞ inch in diameter and made of steel or aluminum. During assembly, the extension arm 40 rotates 360 degrees around the longitudinal axis of the upper section 34 as shown in FIG. 4. The extension arm 40 also slides longitudinally inside the upper section 34 of the extension pole 30, thereby enabling the distance of the support member 70, relative to the fixed pole 20, to be adjusted. A locking nut 36 is used to lock the extension arm 40 in position relative to the upper section 34 of the extension pole 30.

Figure 3:
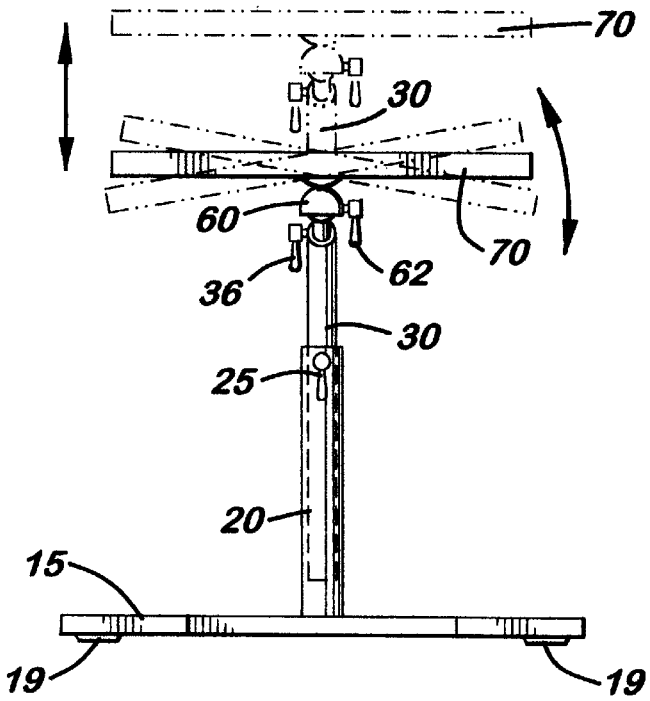
FIG. 3 is a front elevational view of the computer stand showing the lateral tilting movement of the support member.

A planar support member 70 is used to support a keyboard or laptop computer 90. Disposed between the distal end of the extension arm 40 and the support member 70 is a universal joint 60 that enables the support member 70 to tilt approximately 20 degrees on each side of the extension arm 40 horizontal axis, as shown in FIG. 3. The universal joint 60 includes an inverted cup member 61 attached to the bottom surface of the support member 70, a receiving ball 45 attached or integrally formed on the end of the extension arm 40 and a locking latch 62 that locks the cup member 61 on the receiving ball 45. During use, the support member 70 is tilted and rotated to its desired location and then locked in position using the locking latch 62. An optional lip 72 is attached to the rear edge of the support member 70 which prevents a laptop from sliding off the support member 70 when tilted rearward.

Figure 5:
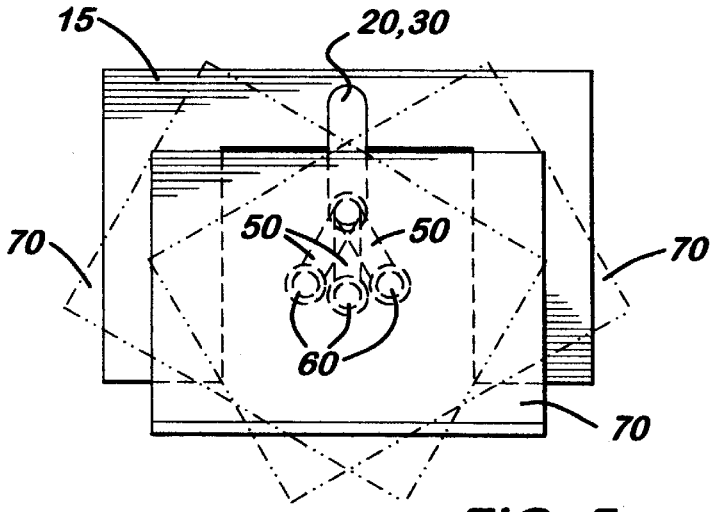
FIG. 5 is a top plan view of a second embodiment of the extension arm that allows additional rotation of the support member.
Figure 6:
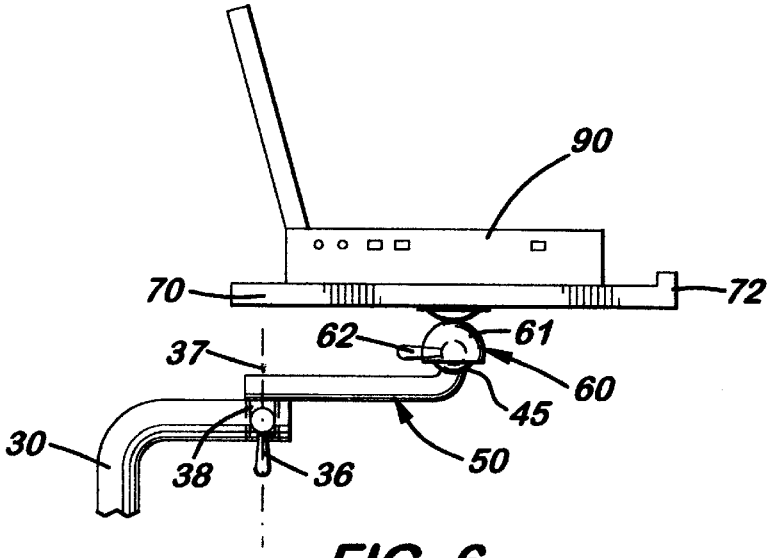
FIG. 6 is a side elevational view of the second embodiment shown in FIG. 5.
Figure 7:
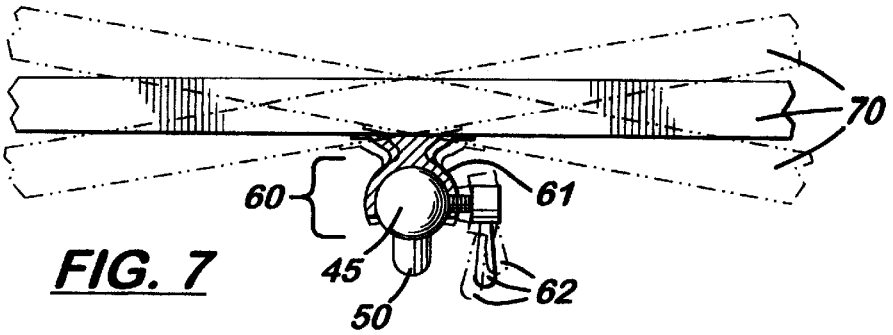
FIG. 7 is a sectional side elevational view of the adjustment nut and upper connector connected to the extension arm.

In a second embodiment shown in FIGS. 5 and 6, the extension arm 40 is replaced with a two-piece extension arm 50 that only rotates 360 degrees around a vertical axis 37 located near the distal end 35 of the extension pole 30. The extension arm 50 includes a perpendicularly aligned neck 52 that extends downward and is inserted into a bore 38 formed on the extension pole 30. During assembly, the neck 52 is extended into the bore 38 to allow the extension arm 50 to rotate as shown in FIG. 5. A locking latch 36 is then used to lock the extension arm 50 in position on the extension pole 30.

Figure 8:
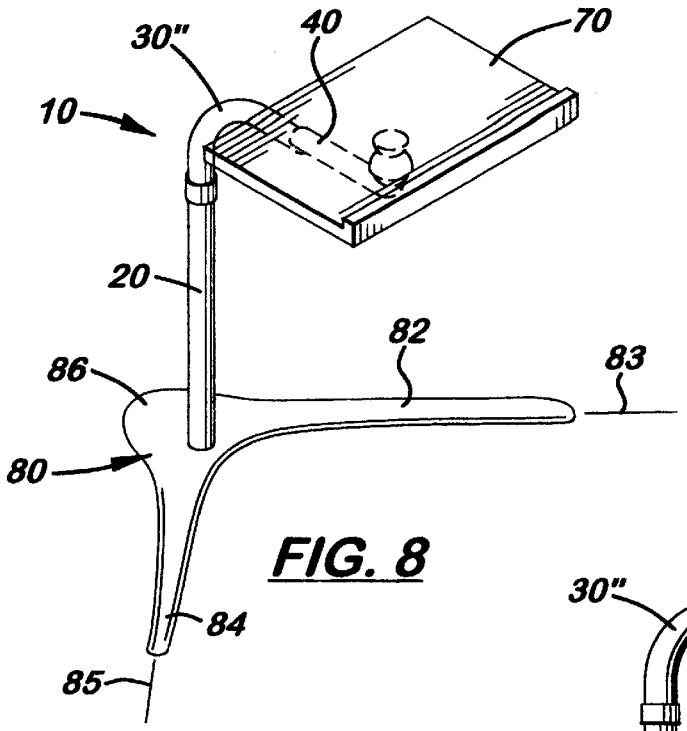
FIG. 8 is a perspective view of a third embodiment of the computer stand showing another embodiment of the base and the extension arm.
Figure 9:
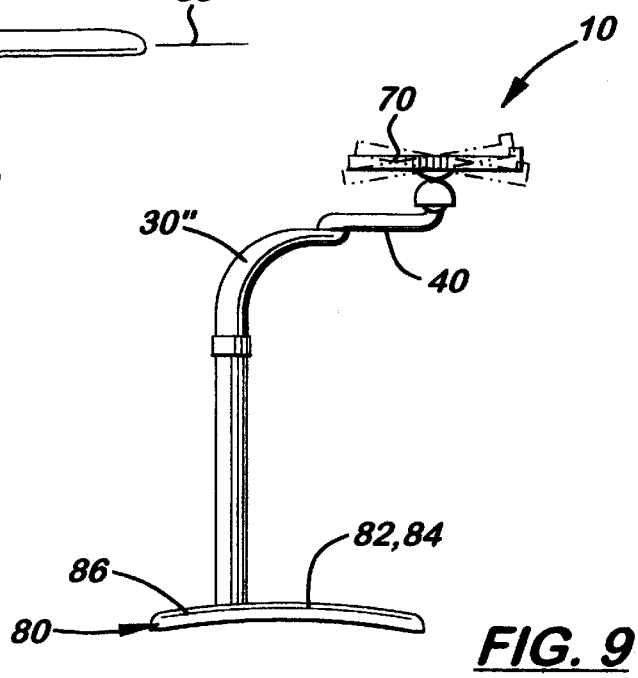
FIG. 9 is a side elevational view of the computer stand shown in FIG. 8.
Figure 10:
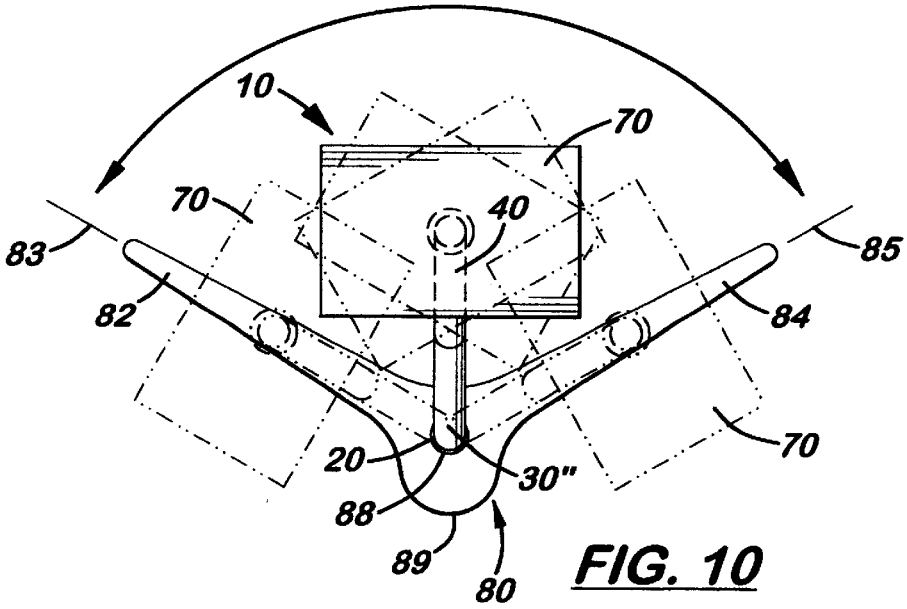
FIG. 10 is a top plan view of the computer stand shown in FIGS. 8 and 9, showing the movement of the support member over the base.

FIGS. 8, 9 and 10 show a third embodiment of the computer stand 10 which uses a Y-shaped base 80, a fixed pole 20, and a curved extension pole 30". Attached to the upper end of the extension pole 30" is the extension arm 40 or extension arm 50 (not shown). The base 80 also includes two elongated arms 82, 84 and a central short leg 86. Formed on the distal end of the pole 30" are two stop surfaces 88, 89, which act to limit the rotation of the extension pole 30" between the longitudinal axis 83, 85 of the arms 82, 84, respectively, and to prevent the stand 10 from tipping over during use.

In compliance with the statute, the invention has been described herein in language more or less specific as to structural features. It should be understood, however, that the invention is not limited to the specific features shown, since the means and construction shown comprise only some of the preferred embodiments for putting the invention into effect. The invention is therefore entitled to any of its forms or modifications within the legitimate and valid scope of the amended claims, appropriately interpreted in accordance with the doctrine of equivalents.

I claim:

1. An adaptable computer stand, comprising:

a. a low profile Y-shaped base which includes two elongated arms and a central leg;

b. a fixed pole, said fixed pole having a lower end and an upper end, said fixed pole being perpendicularly aligned and attached at said proximal end to said base;

c. an extension pole attached to said upper end of said fixed pole, said extension pole having a distal end;

d. a locking means for locking said extension pole to said fixed pole;

e. an extension arm attached to said distal end of said extension pole, said extension arm having a distal end;

f. a second locking means for locking said extension arm to said extension pole;

g. a planar support member for supporting a keyboard or laptop computer, said support member having a lower surface, and;

h. a universal joint attached to said lower surface of said support member, said universal joint capable of being attached to said distal end of said extension pole, thereby enabling said support member to tilt and rotate thereabout; and, i. two stop surfaces formed on said fixed pole to limit rotation of said extension pole between said elongated arms on said base.

2. The adaptable computer stand, as recited in claim 1, a locking means to selectively lock said extension arm in position on said extension pole.

3. The adaptable computer stand, as recited in claim 1, wherein said base extends under a chair which forms a narrow space thereunder that measures approximately less than 1¼ inches in height.

4. The adaptable computer stand, as recited in claim 1, further including means to limit the rotation of said extension arm between the legs of said Y-shaped base.

5. The adaptable computer stand, as recited in claim 1, wherein said extension pole capable of being adjusted in length relative to said fixed pole.

6. The adaptable computer stand, as recited in claim 1, wherein said extension pole is able to rotate around a vertical axis.

7. The adaptable computer stand, as recited in claim 1, where said extension arm is slidingly attached to said extension pole.

8. The adaptable computer stand, as recited in claim 7, wherein said extension arm rotates around a horizontal axis on said extension pole.

* * * * *